United States Patent [19]

Swallow

[11] Patent Number: 4,488,515

[45] Date of Patent: Dec. 18, 1984

[54] HYDRAULIC COLUMN CHOKE AND REAMER

[76] Inventor: David H. Swallow, P.O. Box 1381, Havre, Mont. 59501

[21] Appl. No.: 510,815

[22] Filed: Jul. 5, 1983

[51] Int. Cl.[3] ..... F22B 37/18; F28G 1/00

[52] U.S. Cl. ..... 122/379; 15/104.05; 15/104.1 R; 15/104.16

[58] Field of Search ..... 122/379, 387, 391; 15/104.1 R, 104.05, 104.16; 138/89; 137/318

[56] References Cited

U.S. PATENT DOCUMENTS

| | | | |
|---|---|---|---|
| 711,370 | 10/1902 | Williams | 122/379 |
| 858,663 | 7/1907 | Liebscher | 15/104.1 R |
| 2,675,570 | 4/1954 | Sacks | 15/104.1 R |
| 2,964,290 | 12/1960 | Mueller | 137/318 |
| 3,992,746 | 12/1975 | Strunk | 15/104.16 |
| 4,184,504 | 1/1980 | Carmichael et al. | 137/318 |

*Primary Examiner*—Edward G. Favors
*Assistant Examiner*—Steven E. Warner
*Attorney, Agent, or Firm*—J. Gibson Semmes

[57] ABSTRACT

An hydraulic column choke valve and reamer adapted to hot water heating boilers and the like, permitting maintenance on low water fuel cut-off controls and similar columns without draining, characterized by a universal valve body which interchangeably mounts a reaming assembly and/or choke assembly, the latter of which may be retained in the column after removal of the valve body. The water column choke is adapted to columns of variant horizontal cross section without exchange of the valve body, per se.

2 Claims, 7 Drawing Figures

HYDRAULIC COLUMN CHOKE AND REAMER

BACKGROUND OF THE INVENTION

Boilers which are used in institutional constructions such as hospitals, nursing homes, greenhouses and the like, which lack adequate backup heating protection require constant maintenance. Many boilers, lacking maintenance are damaged and/or destroyed from low water, fuel cut-off control failures. These failures, if not anticipated, not only endanger the life of the boiler, but also result in developing serious conditions which may be destructive of the boiler and/or result in conflagrations to institutional constructions which are served by the boiler. It has been ascertained that 90 percent of boiler accidents occur as a direct result of low-water, fuel cutt-off control failures, due to poor control maintenance or none at all. Contributing to the problem is the fact that most building owners resist opening the boilers up for control maintenance work, due to the resultant of loss of system sealing as in hot water heating boilers, this problem being aggravated by the prospect that stop valves in a given system may be defective to the extent that they do not resist and hold vapor pressures which have built up in a given boiler.

Low water, fuel cut-off control failures are attributable to varying conditions such as:

A. a given control filling with scale and sludge to the point that the control float becomes defective, will not drop and shut off the burner as and when the boiler has exhausted its supply of water;

B. as a control float may become water logged or disconnect from its stem, a handyman engineer may either lock the linkage thereof in place or jump the electrical switch to keep the boiler going rather than drain the boiler of its water, sufficiently to repair the faulty control;

C. worn linkages between the control float stem and electric switch may render the control useless.

In the prior art repairing the control requires draining which often involves loss of system seal, requiring in large systems as much as several days to reestablish seal with the attendant loss in heating effect for a given institutional building and economic failure.

According to this combination invention, one may now isolate the vertical leg of a boiler's water column containing the low water, fuel cut-off control and either repair or replace the control or the complete vertical leg of the boiler water column without draining the boiler and/or risking loss of system seal. With respect to the art, currently extant, the invention is directed to providing a novel system which may be set within a full opening gate valve of a boiler to provide both positive hookup and seal from atmosphere; to provide a universal main valve body capable of use with either reamer or choke. The boiler, reamer and/or choke herein is designed to prevent loss of water during the setting of the choke into the piping or the removal thereof. The body of the present system is adapted for retraction of the choke and/or reamer and to sustain it while preparing for installation or disconnection. Vents provided herein vent off undesired air from the water column. Suitable packing is provided to permit variation of depth of choke while maintaining a given water seal. For the first time a reamer head is provided on the choke assembly, permitting the removal of scale and the like for an optimum uniform seat for the choke.

Within this invention means are provided to insure against loss of water from a pressurized or full system while at the same time preventing air from entering the piping or boiler vessel from the atmosphere. The key safety feature of the invention is to prevent scalding of personnel by means of the use of a packing gland and secondly, the compression rod is provided with a safety plate, capable of slipping back over the wrench element, thereby reducing the possibility of the compression rod assembly being thrust backwards by boiler pressure into the user.

The art is distinguished as follows. In Maish U.S. Pat. No. 2,937,666 the concept involves an internal tube seal which differs in that its purpose is for sealing a tube end, which is capable of introducing a fluid through it for testing purposes. It does not provide means for sealing its operation at all times from the atmosphere, nor is it capable of permitting a choke to be set in place and then removing its housing, thus leaving the choke in place in the piping as and when it may be necessary to remove piping behind it. Moreover, the device of Maish is not provided with a reamer head to allow a more uniform sealing surface on the internal surface of the piping; nor does the stem or compression rod assembly permit its adjustment as to depth to avoid such apparatus within the system as fittings. That concept moreover, would not prevent loss of water and admittance of ar during the operation of setting the choke in place and removing it and the O-ring in that concept would not provide a positive seal inside a pipe having an irregular surface caused from deposits of scale and varying degrees of pitting.

In the MacAllister U.S. Pat. No. 2,214,171, a cleanout tool is defined which differs in that its purpose is restricted to cleaning out, whereas major body components of the present invention serve more than one purpose. Again, through the utilization of MacAllister water will be lost and air allowed to enter the piping when the device is being installed or removed from the piping and sealing the fluid inside, a tapered plug is forced against the head of an open fitting, causing the loss of fluid until the device was sealed.

In the Christman U.S. Pat. No. 775,124, the concept thereof is not equipped with a body or housing to provide a seal when connecting the device or placing the choke in position. Moreover, as before, no means are provided for preventing loss of fluid or admittance of air into piping when the choke is being inserted or removed and no means are provided for purging air from a water column after repairs may have been completed. No safety device is established in this concept, excepting that of a deflector mounted on the handle of the apparatus.

In the Bay U.S. Pat. No. 2,313,042, the concept is directed to a condenser tube reamer such as may be useful in cleaning water cooled tubes of steam surface condensers. It does not provide means of reaming a pipe or tube in a pressurized fluid system without the loss of that fluid whereas in the present invention a seal is provided by means of the packing gland in the valve body to keep the apparatus sealed from the atmosphere at all times.

SUMMARY OF INVENTION

Invention comprises a choke valve which is configured to plug the piping in the water column of hot water heating boilers. It is adapted secifically to maintenance and boiler repairs and can be preformed on the boiler low water fuel cut-off control when necessary as and at the time of the heating season. Advantages herein include significantly reduced down-time when work is required on the column, preventing the possibility of losing system seal if used on a hot water heating boiler, and requiring no draining of the boiler. In the art, draining results in losing treated water or antifreeze inside the boiler vessel and also results in admitting oxygen and impurities back into the boiler as and at the time when raw water is later added to make up for the pure water lost. The valve used herein provides a means of performing annual maintenance on the low water fuel cut-off control, to check for cleanliness and freedom of movement of working parts during such times as when the vessel does not require draining. In general, the boiler should not be in service during attachment of the device to the water column; nonetheless, this invention precludes the necessity for any other down-time such as may be required for draining etc.

Novel features of the valve include the following. The construction requires no casting; the valve body may house either a choke assembly or reaming device without disconnecting the valve body from the boiler water column for the change-over and moreover; the choke assembly is capable of retention inside the water column. The invention thus permits removing the valve body from the column by pulling the body back over the choke rod sleeve and its compression rod as may be required and as is hereinafter described.

The basic components of the invention comprise a universal valve body which may be adapted either to a reaming assembly and/or a choke assembly, the latter of which may include the reaming assembly. The water column choke of the invention includes primarily the universal valve body which is adapted either to reaming and/or choke assemblies each of which has its unique wrench and safety elements. In variation of the invention, means are provided for adapting the water column choke and reamer to water columns of variant size without the necessity of adapting a valve body of differing size.

DESCRIPTION OF THE PREFERRED EMBODIMENTS

Figure 1:
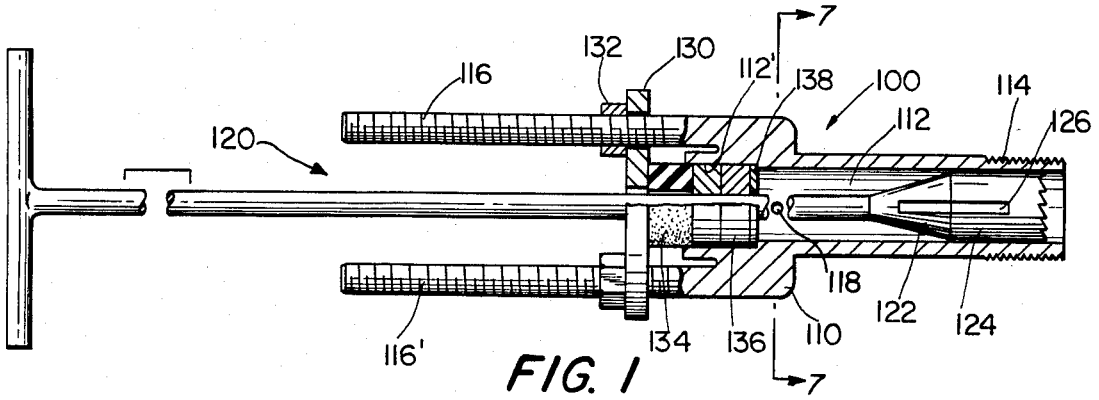
FIG. 1 is a view in side elevation of the combination universal valve body and reamer, portions thereof being broken away.
Figure 2:
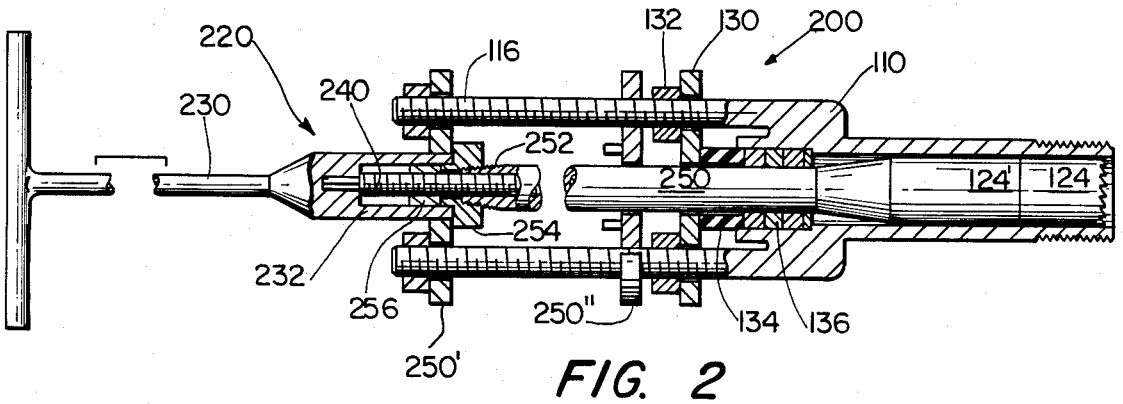
FIG. 2 is a view in side elevation of the combination valve body, choke and reamer assemblies.
Figure 7:
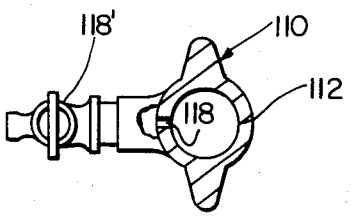
FIG. 7 is view in vertical cross-section of the universal valve body and reamer taken along the lines 7—7 of FIG. 1.

This water column choke comprises a universal main valve body 100, which accommodates both a reaming assembly 120 FIG. 1 and a compression rod assembly 220 FIG. 2. In actual practice, the main valve body 110, consists of a 5 inch schedule 80 steel pipe 112 threaded one inch NPT at one end and bored 1.04 inches in diameter 1 inch deep at the opposite end 112'. Extensions 114 and 116 of the valve body are threaded, as shown. The pipe 112 is provided with an air vent 118 to the exterior (FIGS. 1 and 7), the same being provided with an external petcock 118', this vent 118 together with an external steel coupling and petcock 118' being disposed intermediate the pipe 112 and its packing gland extension 112'. The vent hole and cock valve are provided to facilitate purging air from the water column when refilling the water column and to prevent admittance of air into the boiler. It is also useful in checking for proof of closure of a gate valve located between the choke assembly valve body and the boiler vessel before disconnecting the valve body from the boiler to prevent accidental scalding of personnal. As previously indicated, the valve body 110 is defined as universal in that it is adapted to use either as a mount for the reaming assembly 120 or the choke assembly.

Referring to FIG. 1, the reaming assembly when mounted on the universal valve body 110, comprises reaming rod, said rod being conically expanded in cross-section at 122 and having threaded extension 122' (not shown) to secure a reaming head 124. Slots 126 formed in the reamer and adjacent abutment 122 provide for the by-pass of sediment through the reamer head, the slots having open communication with the reamer interiat. Before shaping the reaming rod, appropriate sealing and securing elements are slidably disposed along the shaft between the ends 122 and the handle. These include the packing gland plate 130, said plate having apertures to accommodate the shank of the reaming rod in the center and the threaded extensions 116 of the universal valve body on either side thereof. As indicated in FIG. 1, the packing gland plate 130 may be forceably disposed against the packing gland compression ring 134 by means of steel nuts 132, which engage the threaded extensions of the valve body. The packing gland compression ring 134 is disposed to the right of the packing gland compression plate 132 and appropriate graphite rope packing 136 or other appropriate packing, follows in its disposition along the shank of the reaming rod, all to the right of the packing gland compression ring, the same being terminated by the washer 138.

It will be appreciated that as the packing gland plate 130 is forced by means of the external nuts 132 against the packing gland compression ring, a suitable friction fit between the shank of the reaming assembly 120 and the packing 136 may be affected within the cavity of the universal valve body 110, permitting sealed movement of the reaming assembly as it is progressively rotated within the valve body to clean the water column and/or associated parts.

Figure 3:
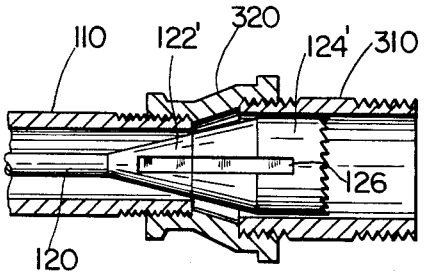
FIG. 3 is a vertical sectional view of an enlarged reamer, adaptor and associated elements, reference the embodiment of FIG. 1.
Figure 4:
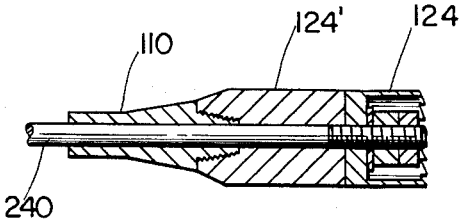
FIG. 4 is a vertical sectional view of an enlarged reamer and choke assembly, reference the embodiment of FIG. 2.

As indicated in FIGS. 3 & 4, the entire valve identified as a water column choke, in either its reaming function or choke and reaming function may be adapted to water columns of variant size by changing reaming heads and choke from one size to another wherein a bell reducer or reducing device and nipple may be adapted to the respective reaming and/or assemblies.

Referring to FIG. 2, like numerals refer to equivalent parts of the FIG. 1 embodiment. The choke assembly is operatively mounted within universal valve body 110 as follows. A compression rod 240 is threaded at ends, the compression rod securing reamer 124 at one extreme, retaining the flexible rubber choke 124' intermediate the reamer and a compression rod sleeve 250. The compression rod sleeve 250 is tapered at ends and threaded, the righthand threading being adapted to engage in corresponding threading of the rubber choke 124' and the lefthand end thereof to engagement by a compression rod sleeve nut 254. It will be appreciated that as and at the time of assembly, the compression applied between the reamer and compression rod sleeve nut 254 by the choke assembly wrench 230 and adaptor 260 turning down or tightening the compression rod nut 256, will effect an expansion of the rubber choke 124' sufficiently to effect an effective seal in the water column under maintenance. When it is necessary to remove the valve body leaving the choke assembly in place, sealing the water column, the compression rod sleeve nut 254 must first be removed allowing the compression rod nut 256 to shoulder directly against the end of the compression rod sleeve 250. This will allow the remaining parts of the choke assembly to pass through the valve body packing gland.

The configuration of the compression rod assembly hand wrench 230 may not be apparent from the drawings, but it is to be noted that the righthand end of the compression rod assembly hand wrench comprises a spanner the dogs of which engage appropriately the compression rod sleeve nut 254 cavities which are formed in one end thereof coaxially with the center. The inner left end of the hand wrench 230 is that of a square slot and engages the outer square shoulders of the compression rod 240 together as a unit. The compression rod sleeve 250 is prevented from rotating while the compression rod nut 256 is being rotated to either engage or disengage the choke by the locking effect of projections formal exteriorly at the compression rod sleeve nut 254 and projections formed on the rod assembly return lever. In addition, the compression rod assembly is provided with a safety plate 250''. This lever is S-shaped in end-view so that when rotated against the housing bolts, one end locks under one bolt whereas the other locks against the top side of the second bolt on the opposite side. In addition, the compression rod assembly is provided with a safety plate 250', the same being adapted to the exterior of the water column choke by means of safety plate nuts 252 which engage the threaded extensions 116 of the universal valve body 110.

With reference to FIGS. 3 & 4 of the drawings, alternate means are provided for establishing reamer and choke elements of increased diameter relative to the piping of the universal valve body and the water column.

With reference to FIG. 3. it will be noted that the construction is adapted to the same valve body 110 and reamer rod 120 as illustrated in FIG. 1. The working end of the rod 120, nonetheless, is provided with a conical element 122', which, together with the enlarged reamer 124 forms at least one elongate slot 126. Preferably three such slots are disposed at 120 degree intervals around the circumference of the respective elements and they each open into the reamer interview for exhaust of scale cuttings and sediment. A nipple to accommodate the increased diameter of the water column is designated 310, said nipples securing by threaded engagement into the bell reducer 320. As indicated, the reamer head is cut with a back angle to conform to the incline of the reamer back angle cone 122'. The reamer itself may be secured to the rod 120 by means of a compression washer and nut assembly, not shown, engaging the protruding threaded portion of the rod, as aforesaid.

The FIG. 4 configuration illustrates accessory compression-reamer components for use in water columns of increased diameter, reference FIG. 2, aforesaid. In this construction the same compression rod sleeve and compression rod as illustrated in FIG. 2 is employed. In this instance however, the flexible choke 124' is provided with a small back angle incline to compensate for increase in diameter relative to its counterpart in FIG. 2. The securing of the components is essentially the same as previously described.

Figure 5:
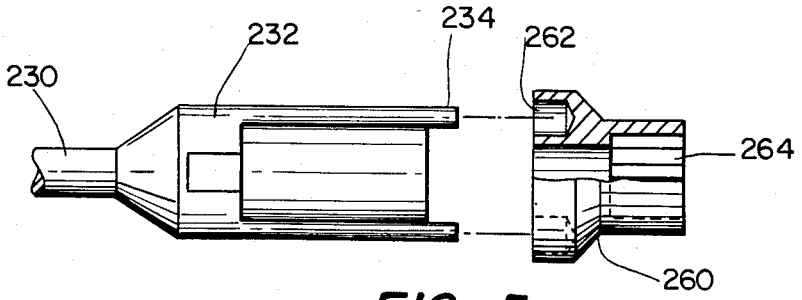
FIG. 5 is a view in side elevation of a combination rod assembly hand wrench tool with associated socket for adjustment of the compression rod nut through the safety plate, reference the embodiment of FIG. 1.

In FIG. 5, means are illustrated for providing together with the FIG. 2 compression rod assembly 250 means for turning of the compression rod not 256 by reaching through the safety plate 250' as and when it may be necessary to disengage or re-engage same. The end dogs on the wrench head 232 are adapted to engage cavities 262 within the adaptor 260, said adaptor having a hollow extension 264 which may pass through the center apertures of the safety plate to engage the compression rod nut for purposes mentioned hereinbefore.

As indicated after thus increasing the diameter of the end components to accommodate a larger diameter water column of FIG. 3, reference element 310, the complete choke assembly would apparently require removal from the water column under maintenance to change from reamer to choke or visa versa. The removal of the valve body 110 out over the end of the compression rod sleeve 250 and rod 240 may still be possible as the larger diameter components would remain inside the column piping. This operation also permits complete removal of the column's vertical leg as long as the chokes are set beyond the unions in both upper and lower horizontal legs on the vessel side of the unions.

For varying wall thicknesses from the use of different pipe schedules, diameters of the plug or choke nd reamers should be made proportional to keep clearances between them and internal surfaces of piping to a minimum. This would help prevent problems such as pushing the choke material over the outer leading edge of a given back angle, a condition which may result in locking the device into the column's piping. Also, by keeping relatively close clearances, one greatly reduces the amount of take-up required to set the choke.

After the universal valve body has been secured to the water column of a hot water heating boiler or the like, and as the choke assembly is inserted into the water column, it should be rotated in a clock-wise direction only as a gentle inward pressure is applied thereby to preclude accidentally unscrewing the reamer head. As heavy resistance may be encountered by virtue of excessive scaling and the like, while getting the combination reamer and choke into place, this is an indication that the column under maintenance is excessively clogged and/or burrs may still exist in the pipe ends from the time the water column was installed. Should an extremely dirty column be met, the separate reaming assembly is desirably installed into the valve body and used, as a reamer head attached to the choke assembly is primarily for providing a smoother surface inside the column for seating of the rubber choke per se. Should internal surfaces of the column be found to be heavily scaled, all connecting legs of the water column must be cleared; furthermore, if the internal surfaces of the column piping are found to have badly deteriorated, this invention will permit such detection. From the aforesaid it will be obvious that the choke is capable os satisfactorily plugging either schedule 40 or 80-pipe.

For a given boiler's water column to accommodate the water column choke valve body it will require a rearrangement of fittings on the conventional 4 way cross fittings connecting the vertical leg of the column to the upper and lower horizontal legs. This will require replacing the steel plugs in the 4 way crosses horizontal openings with a nipple and gate valve each. This then provides the means of installing the assemblies onto the column. Gate valves located in this position are outside of the circulatory path of the water column and when not in use should be plugged with steel plugs or nipples and caps to seal them.

Figure 6:
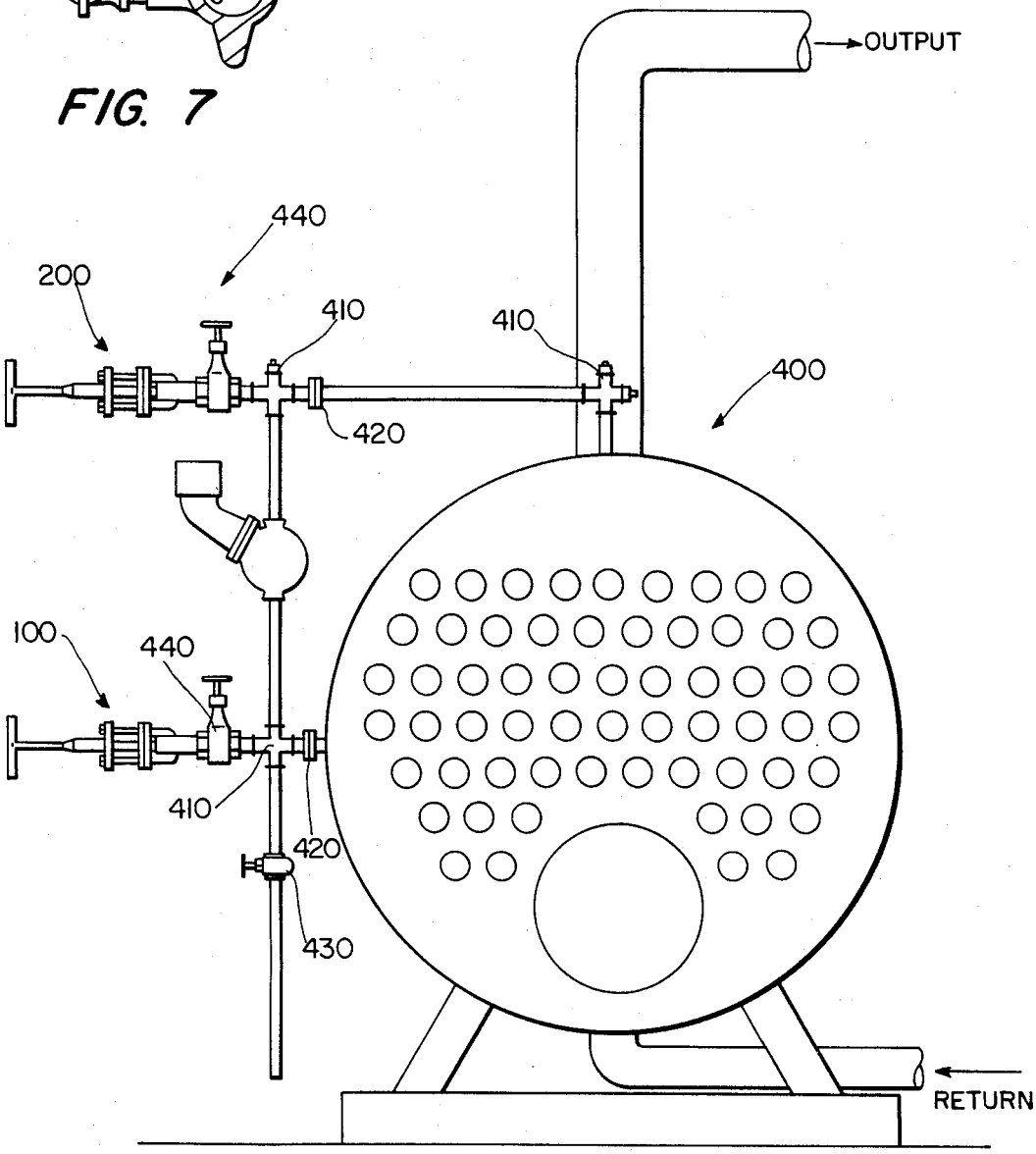
FIG. 6 is a schematic of a conventional boiler system which has been modified to accommodate the tools of the invention.

The schematic of FIG. 6 illustrates manner in which a conventional boiler system may be modified to accommodate the tools of the invention. It will be noted that to the conventional crosses 410 and unions 420 and water column blowdown valve 430 have been added the full opening gate valves 440. Within this modified water column the plugs for sealing the valves when in service are located to the outside of these newly added valves and upon removal of the plugs (not shown), one or the other of assembled tools 100 and 200 are attached for operation.

I claim:

1. A hydraulic column choke and reamer for hydraulic vessels comprising:

A. A tubular valve body engagable with a column of an hydraulic vessel and including means for compression mounting thereof to the column, said valve body defining a valve-controlled air vent therein;

B. A reaming assembly, reciprocably mounted in sealed relation to the valve body, said reaming assembly including a reamer wrench and reamer, the reamer defining a declining inner end with at least one coaxial channel therein to exhaust scale therefrom and a compressive packing gland in the assembly whereby to seal the assembly relative to the valve body;

C. A compression rod and sleeve therefor, a working end of the compression rod and sleeve securing the reamer and a flexible column choke therebetween;

D. A compression packing plate disposed externally adjacent to the flexible column choke to preclude blowout of the choke.

2. In combination with a boiler, wherein the upper and lower horizontal legs of a boiler's water column are equipped with full opening gate valves as permanent fixtures, these being outside the circulating path of the water column and used in place of steel plugs or nipples and caps, wherein the gate valves are plugged when the maintenance function is not exercised, the improvement of an hydraulic column choke and reamer comprising:

A. A tubular valve body engagable with the column of an hydraulic vessel and including means for compression mounting thereof to the column, said valve body defining a valve-controlled air vent therein;

B. A reaming assembly, reciprocably mounted in sealed relation to the valve body, said reaming assembly including a reamer wrench and reamer, the reamer defining an inner end with at least one coaxial channel therein and a compressive packing gland in the assembly whereby to seal the assembly relatve to the valve body;

C. A compression rod and sleeve therefor, a working end of the compression rod and sleeve securing the reamer and a flexible column choke therebetween;

D. A compression packing plate disposed externally adjacent the flexible choke to preclude blowout of the choke.

* * * * *